United States Patent [19]

Flannery

[11] 4,084,815

[45] Apr. 18, 1978

[54] CONTINUOUS TENSION EXERCISER

[76] Inventor: Matt W. Flannery, 310 Berry Ave., Westwood, Ashland, Ky. 40010

[21] Appl. No.: 705,132

[22] Filed: Jul. 14, 1976

[51] Int. Cl.[2] ..... A63B 21/06

[52] U.S. Cl. ..... 272/119; 272/144; 272/62; 272/117; 272/143; 272/126

[58] Field of Search ..... 272/118, 134, 117, 119, 272/135, 142, 116, 137, 96, 126

[56] References Cited

U.S. PATENT DOCUMENTS

| | | | |
|---|---|---|---|
| 2,183,265 | 12/1939 | Maloney | 272/121 |
| 3,117,782 | 1/1964 | Johnson | 272/144 X |

FOREIGN PATENT DOCUMENTS

| | | | |
|---|---|---|---|
| 1,183,144 | 1/1959 | France | 272/117 |
| 78,676 | 10/1933 | Sweden | 272/116 |

*Primary Examiner*—Richard C. Pinkham
*Assistant Examiner*—William R. Browne
*Attorney, Agent, or Firm*—Clarence A. O'Brien; Harvey B. Jacobson

[57] ABSTRACT

A horizontal first structure and a second structure elevated above the first structure are provided and the elevated second structure supports a pulley assembly therefrom including a journaled pulley. Abutment structure is provided on the first horizontal spaced normal from an upstanding plane containing the pulley assembly and against which a person disposed on the first horizontal structure may abut at least a portion of his body to prevent sliding of that person relative to the first horizontal structure toward the aforementioned plane. An elongated flexible tension member has its mid-portion passed over the journaled pulley and a first end portion of the tension member depends downwardly from the journaled pulley and supports a weight body therefrom. The second end portion of the tension member extends downwardly away from the journaled pulley in a direction inclined away from the aforementioned plane and the lower end of the second end portion of the tension member includes structure adapted to be engaged by the free end portion of at least one limb of a person disposed on the first horizontal structure.

23 Claims, 14 Drawing Figures

92
90

40
42
40"
42"
44"
44
42"

37
36'
34'
42'
40'
10'
12'
58'
54'
46'
48'
51'
52
160
140
120
100
80
60
40
20
17
15
14'
13
19
21
50'

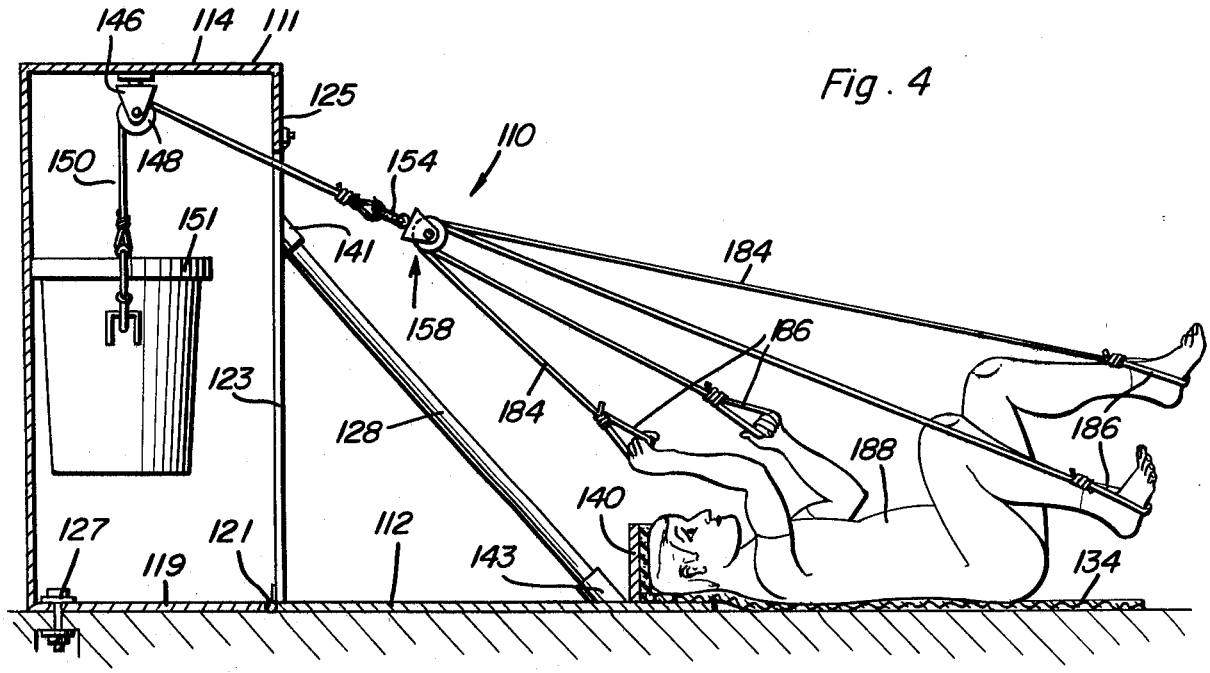
Fig. 4
Fig. 5
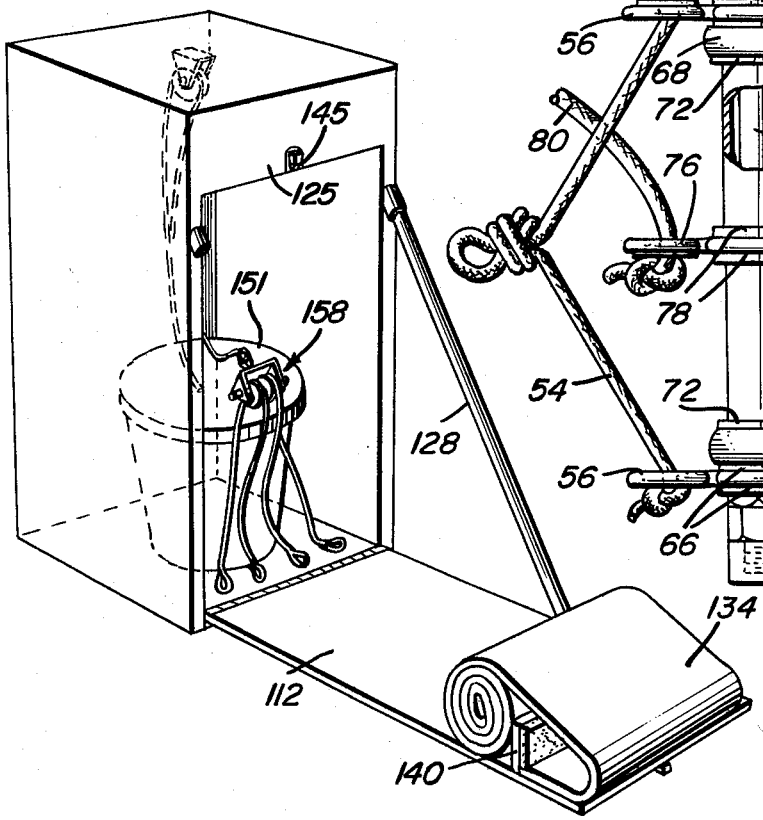
Fig. 6
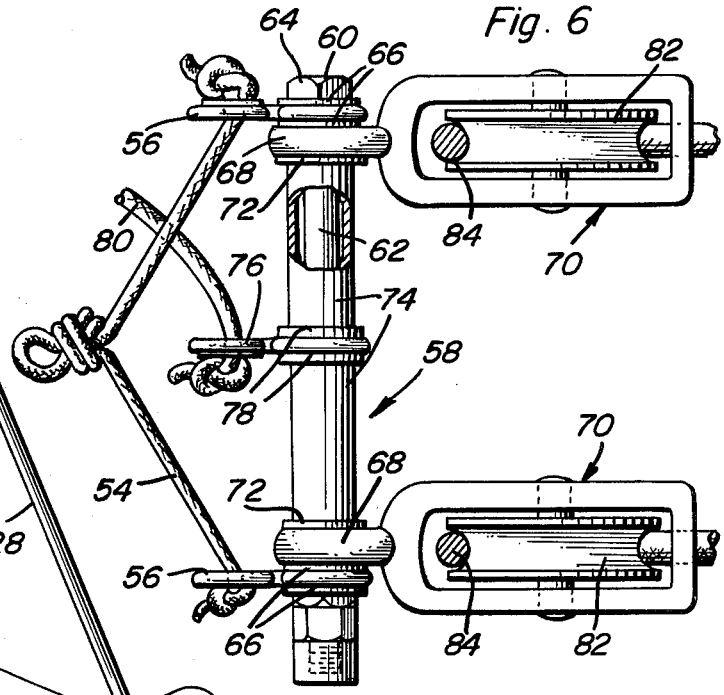

Fig. 11
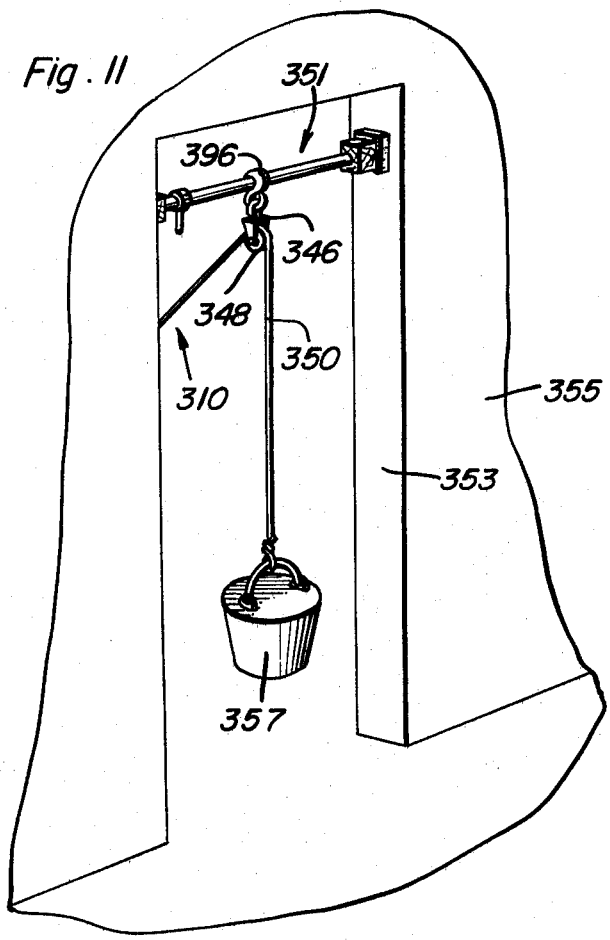
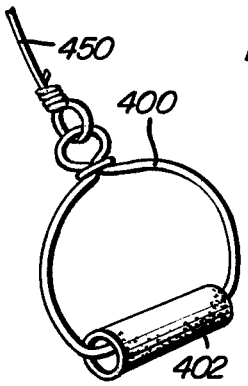
Fig. 13
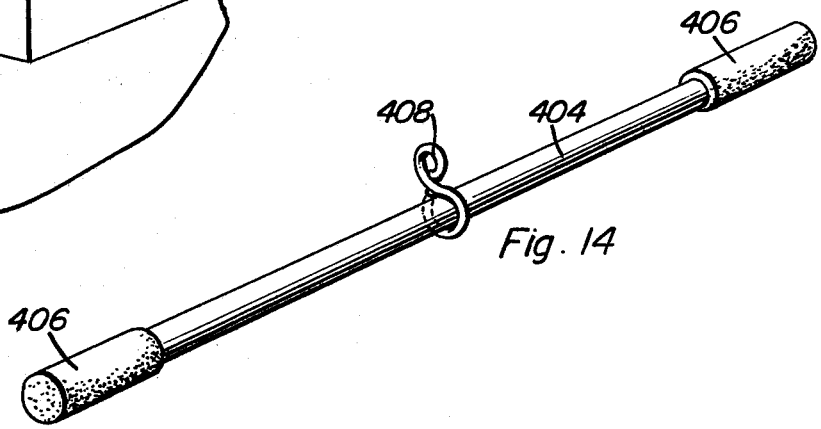
Fig. 14
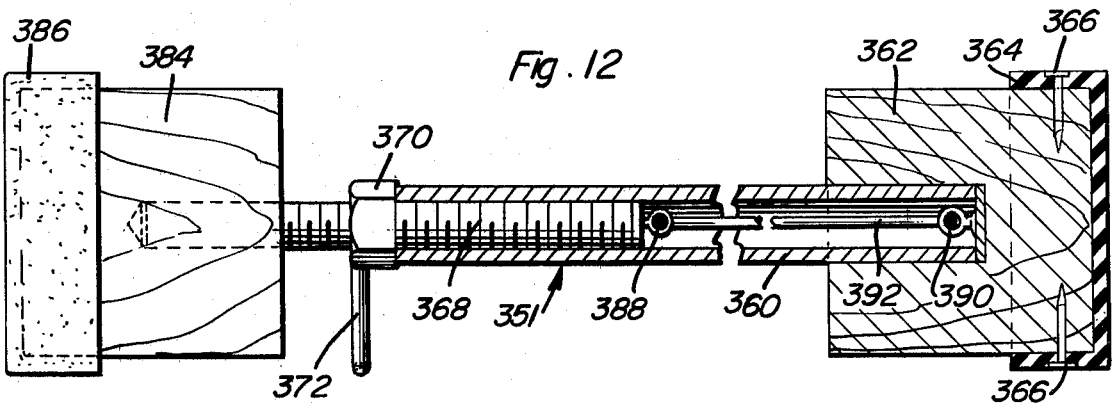
Fig. 12

CONTINUOUS TENSION EXERCISER

BACKGROUND OF THE INVENTION Various types of exercisers have been heretofore designed whereby a first limb of a person carrying out an exercise may be opposed by a second limb of that person. In addition, further exercisers have been provided whereby each limb to be exercised may be opposed by a predetermined amount of weight.

Examples of exercisers of these types are disclosed in U.S. Pat. Nos. 2,716,027, 3,117,782, 3,162,441, 3,834,694 and 3,858,874.

However, most previously known exercising machines are not capable of allowing one limb of a person exercising to function in opposition to another limb with both limbs in opposition opposing a variable weight load in one direction of movement. By such construction controlled exercising of a person's limbs may be carried out in an efficient manner and in a manner whereby the muscles being exercised may have the resistance loading thereon gradually increased throughout an extended period of muscle development through exercising.

BRIEF DESCRIPTION OF THE INVENTION

The exerciser of the instant invention is constructed in a manner whereby one limb may be exercised in opposition to a second limb of the person using the exerciser and the two limbs being exercised may be opposed, in one direction of movement thereof, by adjustable weight loading of the exercise apparatus. Of course, the exercise apparatus may also be utilized to exercise one limb or other body portion at a time, but the most efficient use of the exerciser involves the exercise of two limbs, simultaneously, in opposition to each other.

The main object of this invention is to provide an exercise apparatus which may be used in a controlled manner to simultaneously exercise a pair of limbs of the user of the exercise apparatus and for exercising two pairs of limbs simultaneously, if desired.

Another object of this invention is to provide an exerciser which will enable the two limbs being exercised to be exercised in opposition to each other.

Yet another important object of this invention is to provide an exerciser including structure whereby movement of the two limbs being exercised may be opposed by adjustable weight loading in one direction of movement thereof.

Another very important object of this invention is to provide an exerciser constructed in a manner whereby it may be utilized in a home environment.

A final object of this invention to be specifically enumerated herein is to provide an exerciser which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a longitudinal vertical sectional view of a third form of exerciser constructed in accordance with the present invention;

FIG. 5 is a perspective view of the exerciser illustrated in FIG. 4;

FIG. 6 is an elevational view of an anchoring structure for anchoring the limb exercising ropes of the exerciser to the weight suspension rope of the exerciser illustrated in FIG. 3;

FIG. 11 is a fragmentary perspective view of a fifth form of exerciser constructed in accordance with the present invention;

FIG. 12 is a fragmentary enlarged horizontal sectional view taken substantially upon a plane passing centrally through the doorway mounted anchor bar assembly illustrated in FIG. 11;

FIG. 13 is a perspective view illustrating the manner in which a single limb to be exercised may be operatively connected to the weight supporting rope of the exerciser; and FIG. 14 is a perspective view of a bar attachment which may be utilized in conjunction with the several forms of exercisers disclosed in order to enable simultaneous exercising of two limbs in opposition to the weight loading of the exerciser.

DETAILED DESCRIPTION OF THE INVENTION

Figure 1:
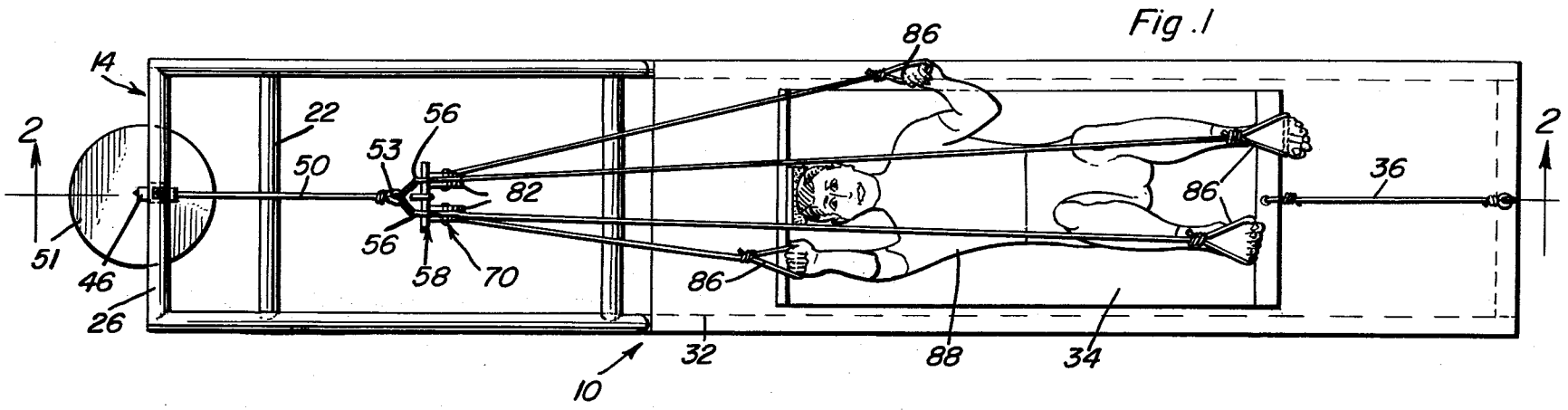
FIG. 1 is a top plan view of a first form of exerciser constructed in accordance with the present invention.
Figure 2:
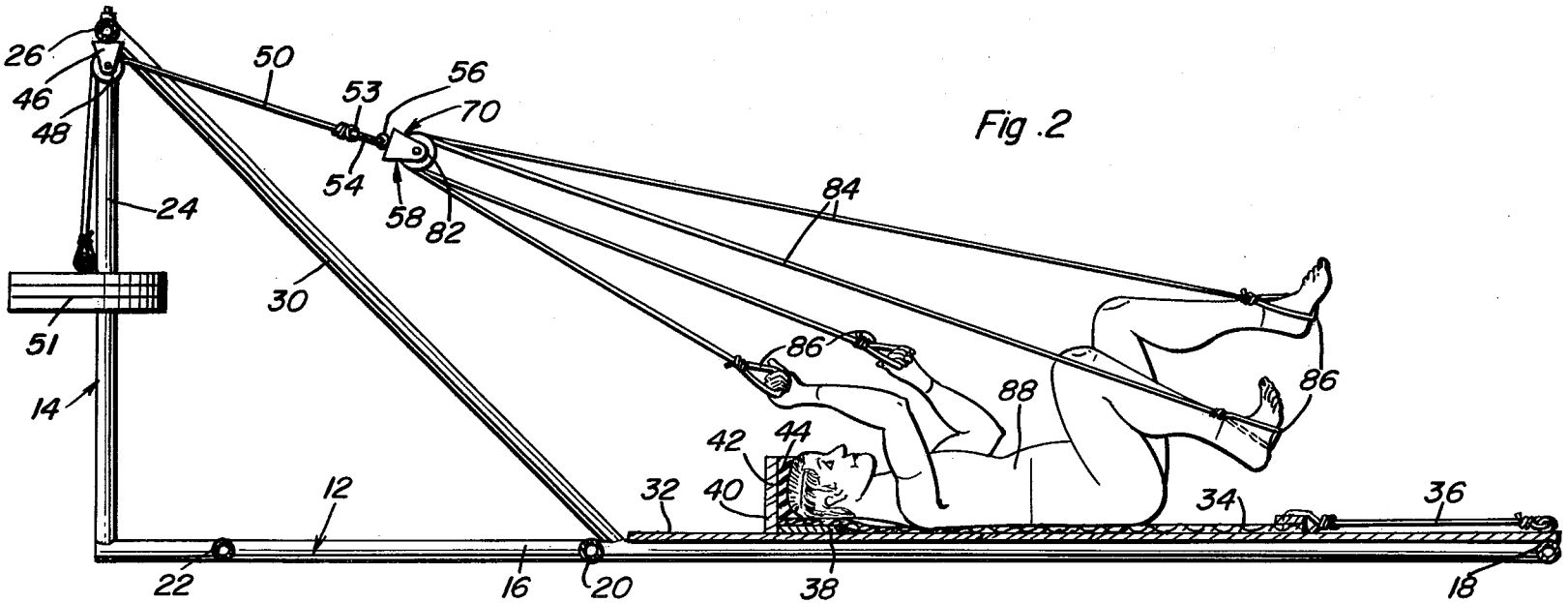
FIG. 2 is a longitudinal vertical sectional view taken substantially upon the plane indicated by the section line 2—2 of FIG. 1.

With reference now more specifically to FIGS. 1 and 2 of the drawings there will be seen first form of exerciser constructed in accordance with the present invention and generally referred to by the reference numberal 10. The exerciser 10 includes a first horizontal frame structure or section referred to in general by the reference numeral 12 and a second upstanding frame structure or section referred to in general by the reference numeral 14. The section 12 includes a pair of opposite side longitudinal tubular members 16 interconnected by means of transverse tubular members 18, 20 and 22 extending between and secured to the longitudinal member 16 at points spaced longitudinally therealong.

The section 14 comprises an inverted U-shaped frame including a pair of depending tubular members 24 interconnected at their upper ends by means of an upper horizontal transverse tubular member or bight portion 26 and the lower ends of the tubular members 24 are secured to the ends of the tubular members 16 remote from the transverse tubular member 18. Further, inclined tubular brace members 30 are connected between the opposite ends of the bight portion 26 and mid-portions of the corresponding longitudinal tubular members 16.

A platform 32 bridges and is secured to the ends of the tubular members 16 outwardly from the inclined brace members 30 and the platform 32 has a load cushioning pad 34 disposed thereon and extending longitudinally therealong. The end of the pad remote from the section 14 is anchored to the transverse tubular member 18 by means of an anchoring tension member 36 and the end of the pad 34 adjacent the section 14 is lapped over and secured to the lower outwardly projecting horizontal flange 38 of an L-shaped head stop 40 including an upstanding flange 42 having its inner surface cushioned as at 44.

A pulley assembly 46 is suitably anchored to the mid-portion of the bight portion 26 and rotatably journals a pulley wheel 48 over which the mid-portion of a flexible line 50 is trained. One end of the line 50 depends downwardly between the legs 24 and has a predetermined amount of weight in the form of a body 51 supported therefrom. The other end of the line 50 inclines outwardly and downwardly from the bight portion 26 toward the end of the section 12 remote from the section 14. That free end of the line 50 is anchored as at 53 to the short bridle 54 having its opposite ends supported from anchor eyes 56 carried by the opposite ends of an anchor assembly referred to in general by the reference numeral 58 and illustrated in greater detail in FIG. 6.

The anchor assembly 58 comprises a bolt 60 including a shank 62 having a head 64 at one end. The anchor eyes 56 are disposed on the opposite ends of the shank 62 between thrust washers 66 and the eye mounting portions 68 of a pair of pulley assemblies referred to in general by the reference numerals 70 are mounted on the shank 62 inwardly of the innermost washers 66. A thrust washer 72 is disposed on the shank 62 inwardly of each eye 68 and a plastic spacing sleeve 74 is disposed on the shank 62 inwardly of each washer 72. Further, a center anchor eye 76 is disposed on the shank 62 between the adjacent ends of the sleeves 74 with washers 78 mounted on the shank 62 between the sleeves 74 and the anchor eye 76.

If it is desired, a safety line 80 may have one end thereof anchored to the eye 76 and the other end thereof anchored to the bight portion 26.

Each of the pulley assemblies 70 includes a journaled pulley wheel 82 and the mid-portion of a flexible tension member 74 is trained over each pulley wheel 82. The free ends of the tension members 84 are equipped with foot and hand engageable loops 86 whereby the hands and feet of a person 88 disposed on the pad 34 may be anchored relative to the tension members 84. Of course, the exerciser 10 illustrated in FIGS. 1 and 2 may then be used to exercise the arms and legs of the person 88 with movement of each leg being opposed by opposite movement of the corresponding arm and all limbs being exercised or only those limbs engaged with one of the tension members 84 may be preloaded by the weight body 51. The padded flange 44 is engaged by the head of the person 88 and the pad 34 is anchored relative to the transverse tubular member 18 thereby preventing movement of the person 88 toward the section 14.

Figures 3, 7, 8:
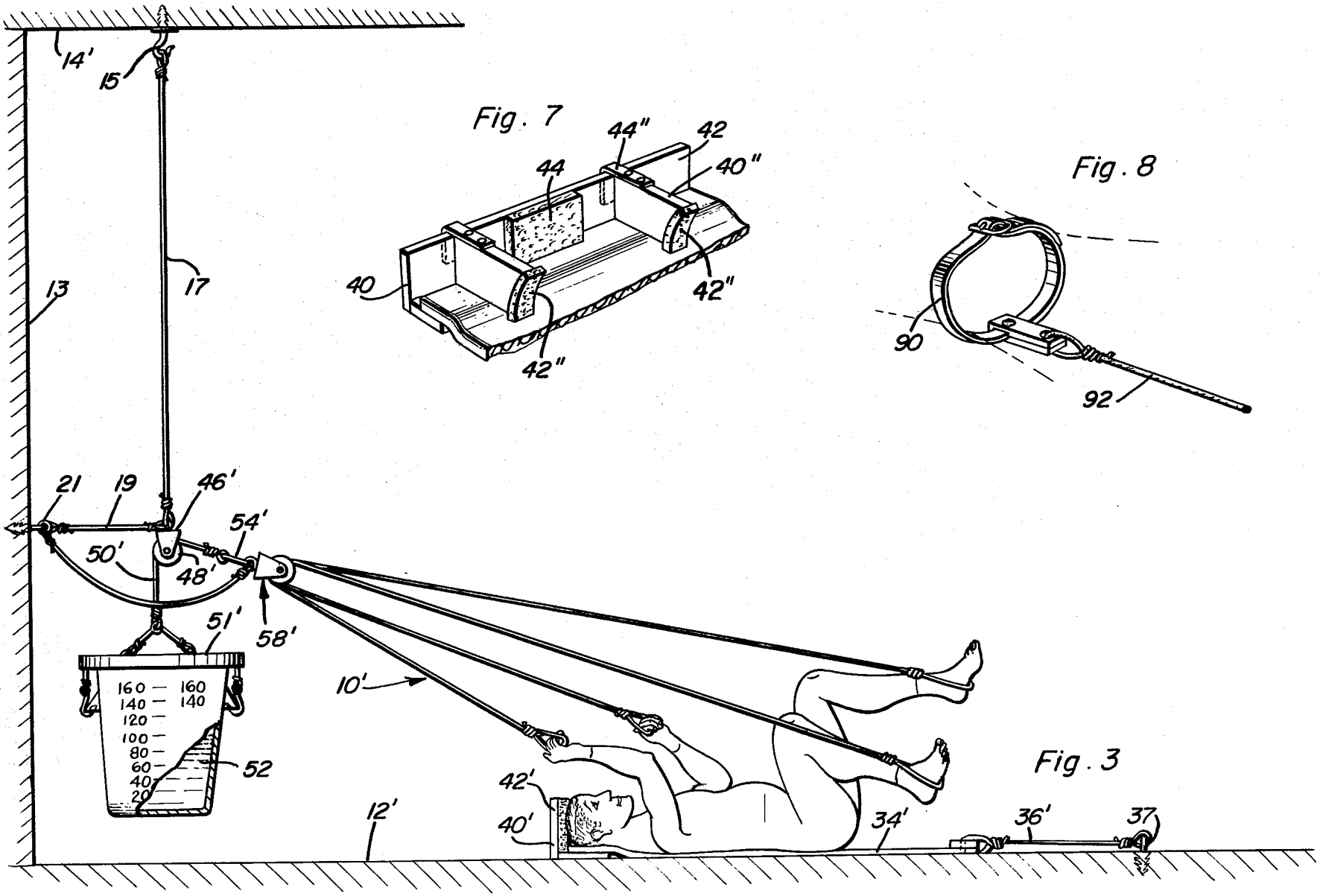
FIG. 3 is a side elevational view of a second form of exerciser constructed in accordance with the present invention.
FIG. 7 is a fragmentary perspective view of a modified form of support and anchoring structure for a person utilizing the exerciser of the instant invention.
FIG. 8 is a perspective view of a further modified form of anchoring structure for a person utilizing the exerciser.

With attention now invited more specifically to FIG. 3 of the drawings, there will be seen a second form of exerciser referred to in general by the reference numeral 10'. The exerciser 10' is similar to the exerciser 10 except that the section 12 is replaced by a floor section 12' of a building and the ceiling structure of section 14' of that building has an anchor hook 15 supported therefrom to which a suspension line 17 is connected, the lower end of the suspension line 17 supporting a pulley assembly 46' therefrom corresponding to the pulley assembly 46. In addition, the pulley assembly 46' is also anchored to a vertical wall 13 extending between the floor 12' and the ceiling 14' by means of a line 19 secured at one end to the pulley 46' and at the other end to an anchor eye 21 engaged in the wall 13.

A line 50' corresponding to the line 50 extends over a journaled pulley wheel 48' of the pulley assembly 46' and one end of the line 50' supports a hollow container 51' therefrom which may be variously filled with water 52 or sand, etc. to obtain a desired weight. The end of the line 50' remote from the container 51' is anchored to the bridle 54' of an anchor assembly referred to in general by the reference numeral 58' and corresponding to the anchor assembly 58.

Additionally, the exerciser 10' includes a pad 34' and anchor member 36' corresponding to the pad 34 and anchor member 36. However, the anchor member 36' is anchored to the floor structure 12' by means of an anchor eye 37. Further, the pad 34' includes a head stop 40' corresponding to the head stop 40 and including a padded upstanding flange 42'. Thus, it may be seen that the exerciser 10' may be used in substantially the same manner as the exerciser 10.

With reference now more specifically to FIGS. 4 and 5 of the drawings there may be seen a third form of exerciser referred to in general by the reference numeral 110. The exerciser 110 differs from the exercisers 10 and 10' in that an upstanding cabinet 111 is provided including a hinged front wall section 112 and a top wall 114. The front wall section 112 is hinged to the forward marginal edge portion of the lower wall 119 of the cabinet 111 as at 121 for movement between the open horizontal position thereof illustrated in FIG. 4 of the drawings to an upstanding position closing the opening 123 formed in the front wall 125 of the cabinet 111. A pulley assembly 146 corresponding to the pulley assembly 46 is supported from the inner surface of the top wall 114 and a line 150 corresponding to the line 50 is trained over the pulley wheel 148 of the pulley assembly 46 and supports a bucket or container 151 corresponding to the container 51 at one end with the other end of the line 150 extending through the opening 123 and being anchored to the bridle 154 of an anchor assembly 158 corresponding to the anchor assembly 58 and having a pair of ropes or tension members 184 operatively engaged therewith corresponding to the members 84 and having hand and foot engageable loops 186 on their free ends corresponding to the loops 86.

The cabinet 110 may be anchored relative to a horizontal support surface by means of suitable anchor structure 127 secured through the bottom wall 119 of the cabinet 111. In addition, if the anchor structure 127 is not provided or if additional bracing between the front wall section 112 and the cabinet 111 is desired, inclined braces 129 may be secured between opposite side portions of the front wall 125 of the cabinet 111 and the inner surfaces of the front wall section 112 when the latter is in the open horizontal position illustrated in FIG. 4. Further, a head stop 140 corresponding to the head stop 40 is supported on the inner surface of the free swinging edge portion of the front wall section 112 and has a pad 134 operatively associated therewith corresponding to the pad 34, the pad 134 being rollable into a stored position thereof such as that illustrated in FIG. 5 and the bracing members 128 being removable from their supporting sockets 141 and 143 and receivable within the cabinet 111 before the front wall section 112 is swung to the closed position closing the opening 123, a latch structure 145 being provided on the front wall 125 for retaining the front wall section 112 in a closed position. Further, the line 150 and anchor assembly 158 as well as the ropes 184 may be wholly contained within the cabinet 111 with the container 151 when the cabinet 111 is closed. Of course, the exerciser 110 may be used in substantially the same manner as the exercisers 10 and 10'.

Figure 9:
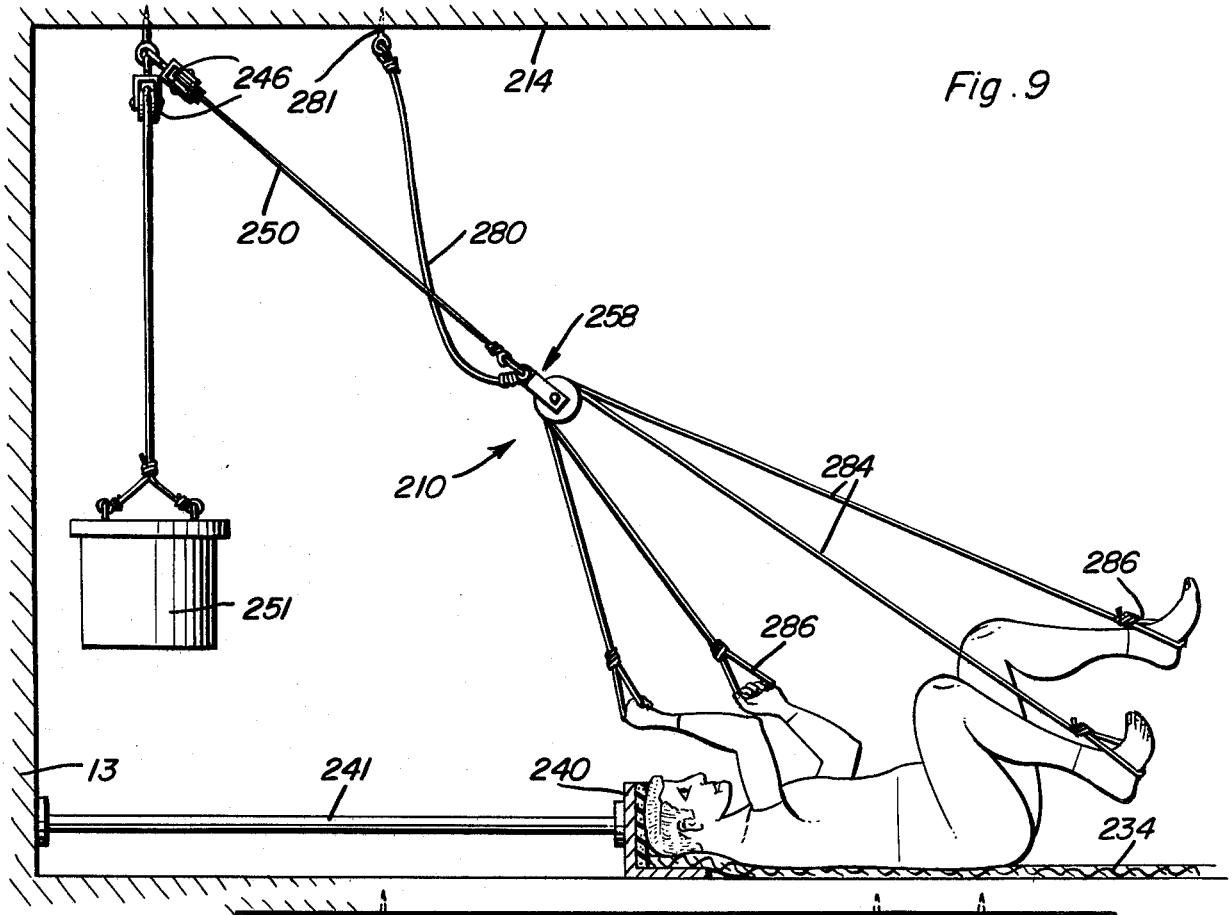
FIG. 9 is a side elevational view of a fourth form of exerciser constructed in accordance with the present invention.
Figure 10:
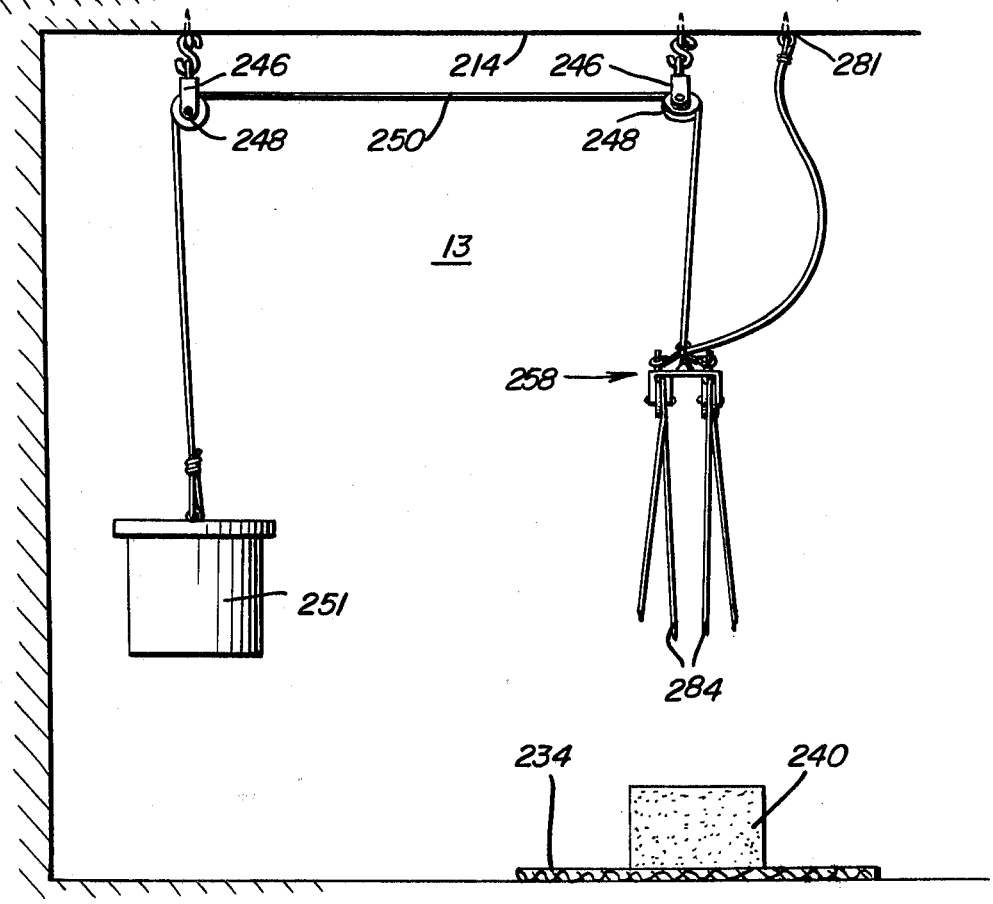
FIG. 10 is a front elevational view of the assemblage illustrated in FIG. 9.

With attention now invited more specifically to FIGS. 9 and 10 of the drawings there will be seen a fourth form of exerciser referred to in general by the reference numeral 210. The exerciser 210 is similar to the exerciser 10' except that the head stop 240 thereof is braced relative to the upstanding wall 13 by means of a rod 241, a pad 234 corresponding to the pad 34' being utilized in conjunction with the head stop 240. In addition, the anchor assembly 258 corresponding to the anchor assembly 58' has its safety line 280 anchored to the ceiling 214 by means of an anchor eye 281 and the line 250 passes over the pulleys 248 of a pair of pulley assemblies 246 anchored relative to the ceiling 214 with the two pulley assemblies 246 spaced along the wall 13. Also, the anchor assembly 258 includes lines 284 and loops 286 corresponding to the lines and loops 84 and 86 and a weight 251 corresponding to weight 151.

With attention now invited more specifically to FIGS. 11 and 12 of the drawings, it may be seen that a fifth form of exerciser referred to in general by the reference numeral 310 may be provided. The exerciser 310 differs from the three previously described exercisers only in that the line 350 thereof is passed over the pulley wheel 348 of a pulley assembly 346 anchored to the mid-portion of an extendable rod assembly referred to in general by the reference numeral 351 mounted in the upper portion of a doorway opening 353 formed in a wall 355. The weighted end of the line 350 supports a container for weight 357 corresponding to the weight 52 and the rod assembly 351 comprises a first tubular section 360 having an abutment block 362 supported from one end thereof, the abutment block 362 being padded with a sheet 364 of resilient material secured thereto by means of nails 366. The end of the tubular member 360 remote from the abutment block 362 has one end of an externally threaded rod 368 telescoped thereinto, a threaded thrust nut 370 being threaded on the end of the rod 368 projecting outwardly of the tubing member 360 and being provided with a laterally directed handle 372 for applying rotational torque to the nut 370. The end of the rod 368 remote from the end thereof telescoped into the tubular member 360 is embedded in an abutment block 384 corresponding to the block 362 and which is also provided with a resilient covering 386 corresponding to the covering 364.

The end of the rod 368 telescoped into the tubing member 360 includes an eye member 388 and the end of the tubing member 360 embedded in the abutment block 362 includes a similar eye member 390. An elastic tension member 392 is connected between the eye members 388 and 390 and thereby urges the rod 368 toward its maximum retracted position within the tubular member 360 as determined by the position of the nut 370 on the rod 368.

The rod assembly 351 is disposed within the opening 353 and then expanded into selected position within the upper part of the opening 353 by threading the nut 370 on the rod 368 in order to forcibly extend the rod 368 relative to the tubular member 360. Of course, the center portion of the rod assembly 351 has an anchor eye 396 supported therefrom by which the pulley assembly 346 is supported from the rod assembly 351.

The exerciser 310 may include a user supporting structure such as that provided in conjunction with the exerciser 10' and will of course be usable by the user of the exerciser 310 is substantially the same manner as the exercisers 10, 10', 110 and 210 are used.

With attention now invited more specifically to FIG. 13, it will be seen that a handgrip ring 400 including a resilient handgrip portion 402 may be directly connected to a line 450 corresponding to one of the lines 50, 50', 150, 250 or 350 in the event only a single limb of the person using the exerciser is to be exercised at any given time. In addition, an elongated rod 404, see FIG. 14, having opposite end handgrips 406 and a center anchor eye 408 may be directly connected to the line 450, if desired. In this manner, the arms of the user of the exerciser may simultaneously exercise both arms in the same manner.

With attention now invited more specifically to FIG. 7 of the drawings, it may be seen that the head stop 40 may have a pair of shoulder abutment boards 40" equipped with pads 42" on one pair of corresponding ends and L-shaped mounting brackets 44" on the other pair of corresponding ends thereof removably engaged with the upstanding flange 42 of the head stop 40. Of course, the upper portions of the shoulders of the user 88 of FIG. 2 may be engaged with the pads 42" of FIG. 7 while the head of the user 88 is engaged with the pad 44 of the head stop 40.

With attention now invited more specifically to FIG. 8 of the drawings there may be seen a waist-encircling belt 90 which may be removably secured about the waist of the user of any of the exercising devices hereinbefore described. One end of an anchor tension member 92 is secured to the belt 90 and the other end of the anchor tension member 92 may be utilized in the same manner as the members 36 and 36'.

The various lightweight containers 51, 151 and 251 may be filled with water or said, etc. to achieve the desired weight value by the user. Further, the amount of exercise which may be performed in a given time may be varied by varying the speed at which exercises are carried out. Also, a pair of limbs being exercised are opposed by the specific weight used and the exerciser should be used in a manner to exercise one or two pairs of limbs while the specific weight being used is maintained at least substantially motionless, thereby also developing coordination.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a horizontal first structure and a second structure elevated above said first structure, pulley means in anchored relation to said second structure, abutment means on said first structure spaced normal from an upstanding plane containing said pulley means and against which a person disposed on said first structure may abut at least one portion of his body to prevent sliding of said person relative to said first structure toward said plane, a first elongated flexible tension member having its mid-portion passed over said pulley means, a first end portion depending downwardly from said pulley means and a second end portion extending downwardly from said pulley means toward said first structure at an incline away from said plane, gravity weight means of constant predetermined selected value supported from a lower portion of said first end portion and anchor means supported from a lower portion of said second end portion adapted to be engaged by the free end portion of at least one limb of a person supported from said first structure, a pulley assembly supported from said lower portion of said second end portion, said anchor means including a second elongated flexible tension member having its longitudinal mid-portion guidingly engaged over said pulley assembly and including opposite end baby limb engageable portions for engagement by arm and/or leg limbs with forces exerted by the limbs engaged therewith in opposition to the constant predetermined selected gravity weight value of said weight means supported from said lower portion of said first end portion of said first tension member.

2. The combination of claim 1 wherein said second structure includes a horizontal lengthwise extendable elongated support bar assembly.

3. The combination of claim 2 wherein said bar assembly includes a first elongated tubular section and a second elongated section having one end portion telescoped into one end of said first tubular section, the other ends of said first and second sections including enlarged endwise outwardly facting abutment portions, the thrust means connected between said sections, operative to forcibly extend said second section relative to said first section, an upstanding wall structure having an opening formed therethrough including opposite side upstanding marginal portions, said bar assembly being supported from and forcibly extended between said marginal portions, said first structure being stationarily anchored relative to said wall structure.

4. The combination of claim 3 wherein said second section is externally threaded and said thrust means includes an abutment threaded on said second section and abutted against said one end of said first section.

5. The combination of claim 4 including elastic means enclosed within said first section and connected between the latter and said second section yieldingly biasing said section toward a retracted position relative to said first section.

6. The combination of claim 1 wherein said end structures include rings attached to the opposite end portions of said second tension member.

7. The combination of claim 1 wherein said first and second structures are rigidly interconnected as a single unit and include elongated horizontal and generally vertical frame sections with the lower end of said vertical frame section anchored to one end of said horizontal frame section.

8. The combination of claim 7 wherein said horizontal frame section includes an upwardly facing surface portion upon which a reclining person may rest.

9. The combination of claim 8 wherein said abutment means includes an upstanding abutment surface facing away from said vertical frame section against which a reclining person may abut the top of his head.

10. The combination of claim 1 wherein said second and first structures include an upstanding cabinet having an opening in one upstanding side thereof and a vertically swingable closure for said opening hingedly supported from said cabinet for oscillation about a horizontal axis adjacent the lower marginal portion of said opening between a horizontal position projecting outwardly from said one upstanding side and an upright position closing said opening, said pulley means being anchored relative to and within an upper portion of said cabinet and said second end portion of said tension member projecting outwardly through said opening, said weight means and said first end portion of said tension member being supported with said cabinet.

11. The combination of claim 10 including inclined brace means releasably connected between an upper portion of said cabinet and the free swingable end of said closure when the latter is in said horizontal position.

12. The combination of claim 1 wherein said first and second structures comprise floor and ceiling structures defining a room of a building, a pad disposed on said floor structure and to which said abutment means is anchored.

13. The combination of claim 12 wherein said abutment means includes a portion thereof abutted against an upstanding wall structure extending between said floor and ceiling structures and defines an upstanding abutment surface facing away from and spaced appreciably from said wall structure.

14. The combination of claim 13 wherein said pulley means comprises first and second pulleys supported from said ceiling structure at points spaced apart horizontally along said wall structure, said first end portion extending downwardly from one of said pulleys, said second end portion extending downwardly from the other of said pulleys, and said mid-portion extending between said pulleys.

15. The combination of claim 12 wherein said pulley means is suspended from said ceiling structure by means of a depending tension member and anchored relative to an upstanding wall structure extending between said floor and ceiling structures by a tension member.

16. The combination of claim 15 including means removably anchoring said pad to said floor against shifting relative thereto toward said wall structure.

17. The combination of claim 15 wherein said abutment means defines an upstanding abutment surface facing away from said wall structure.

18. The combination of claim 1 wherein said abutment means comprises a belt adapted to be removably secured about the waist of the user and including means anchoring said belt relative to said floor structure against movement toward said wall structure.

19. The combination of claim 1 wherein said abutment means includes three horizontally facing abutment surface portions facing away from said plane and adapted to be engaged by the upper head and shoulder portions of the user.

20. The combination of claim 1 wherein said pulley assembly includes an elongated rod member including center and opposite end anchor members supported therefrom, a short elongated bridle member extending between and having its opposite ends secured to said opposite end anchor members, the mid-portion of said bridle member having the free end of said second end portion anchored thereto, a pair of pulley structures supported from the opposite ends of said rod members, each pulley structure including a journaled pulley wheel, said second and a third tension members each having a mid-portion thereof passed about a corresponding pulley wheel and equipped with hand and foot engageable members on its free ends.

21. The combination of claim 20 wherein said rod member includes a center anchor member supported therefrom to which one end of a flexible safety line is secured, the other end of said safety line being anchored to said second structure.

22. In combination with an elevated support structure, first pulley means supported from said support structure, first elongated flexible tension member means guidingly engaged over said pulley means for lengthwise back and forth shifting relative to said pulley means and including a depending first end portion from which a gravity weight is suspended, said weight being of constant predetermined selected value, second pulley means anchored relative to the second end of said first tension member means, second elongated flexible tension member means guidingly engaged over said second pulley means, and body limb engageable portions carried by the opposite ends of said second elongated tension member means, said limb engageable portions adapted to be engaged by arm and/or leg limbs with forces exerted by the limbs engaged therewith in opposition to the contant predetermined selected gravity weight value of said weight means suspended from said first end portion of said first tension member means.

23. The combination of claim 22 wherein said second pulley means includes a pair of pulleys, said second tension member means including a pair of tension members each trained over one of said pulleys, each of said pair of tension members including a body limb engageable portion carried by each end thereof.

* * * * *